US009963985B2

(12) United States Patent
Chouhan et al.

(10) Patent No.: US 9,963,985 B2
(45) **Date of Patent: *May 8, 2018**

(54) TURBOMACHINE AND TURBINE NOZZLE THEREFOR

(71) Applicant: General Electric Company, Schenectady, NY (US)

(72) Inventors: Rohit Chouhan, Karnataka (IN); Gunnar Leif Siden, Greenville, SC (US); Andre Borisenko, Simpsonville, SC (US); Ibrahim Sezer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 306 days.

This patent is subject to a terminal disclaimer.

(21) Appl. No.: 14/973,886

(22) Filed: Dec. 18, 2015

(65) Prior Publication Data

US 2017/0175555 A1 Jun. 22, 2017

(51) Int. Cl.
*F01D 5/14* (2006.01)
*F01D 9/04* (2006.01)

(52) U.S. Cl.
CPC ..... *F01D 9/041* (2013.01); *F05D 2220/32* (2013.01); *F05D 2240/122* (2013.01); *F05D 2250/70* (2013.01); *F05D 2250/90* (2013.01)

(58) Field of Classification Search
CPC ..... F01D 5/141; F01D 9/04; F05D 2240/122; F05D 2240/123; F05D 2240/124; F05D 2240/128; F05D 2240/304
See application file for complete search history.

(56) References Cited

U.S. PATENT DOCUMENTS 6,375,420 B1 * 4/2002 Tanuma ..... F01D 5/141 416/223 A
6,450,770 B1 9/2002 Wang et al.
6,779,973 B2 * 8/2004 Ito ..... F01D 5/141 416/223 A
7,048,509 B2 * 5/2006 Tominaga ..... F01D 5/14 416/223 A (Continued)

FOREIGN PATENT DOCUMENTS

WO 03/006798 A1 1/2003

OTHER PUBLICATIONS

International Search Report and Written Opinion issued in connection with related PCT Application No. PCT/PL2015/050069 dated Aug. 18, 2016.

(Continued)

*Primary Examiner* — Ninh H Nguyen
(74) *Attorney, Agent, or Firm* — James W. Pemrick; Ernest G. Cusick; Frank A. Landgraff

(57) ABSTRACT

A turbomachine includes a plurality of nozzles, and each nozzle has an airfoil. The turbomachine includes opposing walls defining a pathway into which a fluid flow is receivable to flow through the pathway. A throat distribution is measured at a narrowest region in the pathway between adjacent nozzles, at which adjacent nozzles extend across the pathway between the opposing walls to aerodynamically interact with the fluid flow. The airfoil defines the throat distribution, and the throat distribution reduces aerodynamic loss and improves aerodynamic loading on each airfoil.

18 Claims, 8 Drawing Sheets

(56) References Cited

U.S. PATENT DOCUMENTS

| | | | |
|---|---|---|---|
| 8,967,959 | B2 | 3/2015 | Stein et al. |
| 8,998,577 | B2 | 4/2015 | Gustafson et al. |
| 2013/0104550 | A1 | 5/2013 | Smith et al. |

OTHER PUBLICATIONS

International Search Report and Written Opinion issued in connection with related PCT Application No. PCT/PL2015/050070 dated Aug. 18, 2016.

* cited by examiner

TURBOMACHINE AND TURBINE NOZZLE THEREFOR

BACKGROUND OF THE INVENTION

The subject matter disclosed herein relates to turbomachines, and more particularly to, a nozzle in a turbine.

A turbomachine, such as a gas turbine, may include a compressor, a combustor, and a turbine. Air is compressed in the compressor. The compressed air is fed into the combustor. The combustor combines fuel with the compressed air, and then ignites the gas/fuel mixture. The high temperature and high energy exhaust fluids are then fed to the turbine, where the energy of the fluids is converted to mechanical energy. The turbine includes a plurality of nozzle stages and blade stages. The nozzles are stationary components, and the blades rotate about a rotor.

BRIEF DESCRIPTION OF THE INVENTION

Certain embodiments commensurate in scope with the originally claimed subject matter are summarized below. These embodiments are not intended to limit the scope of the claimed subject matter, but rather these embodiments are intended only to provide a brief summary of possible forms of the claimed subject matter. Indeed, the claimed subject matter may encompass a variety of forms that may be similar to or different from the aspects/embodiments set forth below.

In an aspect, a turbomachine includes a plurality of nozzles, and each nozzle has an airfoil. The turbomachine includes opposing walls defining a pathway into which a fluid flow is receivable to flow through the pathway. A throat distribution is measured at a narrowest region in the pathway between adjacent nozzles, at which adjacent nozzles extend across the pathway between the opposing walls to aerodynamically interact with the fluid flow. The airfoil defines the throat distribution, and the throat distribution reduces aerodynamic loss and improves aerodynamic loading on each airfoil.

In another aspect, a nozzle has an airfoil, and the nozzle is configured for use with a turbomachine. The airfoil has a throat distribution measured at a narrowest region in a pathway between adjacent nozzles, at which adjacent nozzles extend across the pathway between opposing walls to aerodynamically interact with a fluid flow. The airfoil defines the throat distribution, and the throat distribution reduces aerodynamic loss and improves aerodynamic loading on the airfoil. The throat distribution, as defined by a trailing edge of the nozzle, may extend curvilinearly from a throat/throat mid-span value of about 111% at about 0% span to a throat/throat mid-span value of about 100% at about 51% span, to a throat/throat mid-span value of about 123% at about 100% span, and the span at 0% is at a radially inner portion of the airfoil and a span at 100% is at a radially outer portion of the airfoil. The throat distribution may be defined by values set forth in Table 1, where the throat distribution values are within a +/−10% tolerance of the values set forth in Table 1. A trailing edge of the airfoil has a protrusion at about 50% span. A trailing edge of the airfoil may have an offset of about 0 at 0% span, about 100% at about 50% span and 0 at 100% span. A trailing edge of the airfoil may have an offset as defined by values set forth in Table 2. The airfoil may have a thickness distribution (Tmax/Tmax_Midspan) as defined by values set forth in Table 3. The airfoil may have a non-dimensional thickness distribution according to values set forth in Table 4. The airfoil may have a non-dimensional axial chord distribution according to values set forth in Table 5.

In yet another aspect, a nozzle has an airfoil, and the nozzle is configured for use with a turbomachine. The airfoil has a throat distribution measured at a narrowest region in a pathway between adjacent nozzles, at which adjacent nozzles extend across the pathway between opposing walls to aerodynamically interact with a fluid flow. The airfoil defines the throat distribution, and the throat distribution defined by values set forth in Table 1, where the throat distribution values are within a +/−10% tolerance of the values set forth in Table 1. The throat distribution reduces aerodynamic loss and improves aerodynamic loading on the airfoil.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION OF THE INVENTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," and "the" are intended to mean that there are one or more of the elements. The terms "comprising," "including," and "having" are intended to be inclusive and mean that there may be additional elements other than the listed elements.

Figure 1:
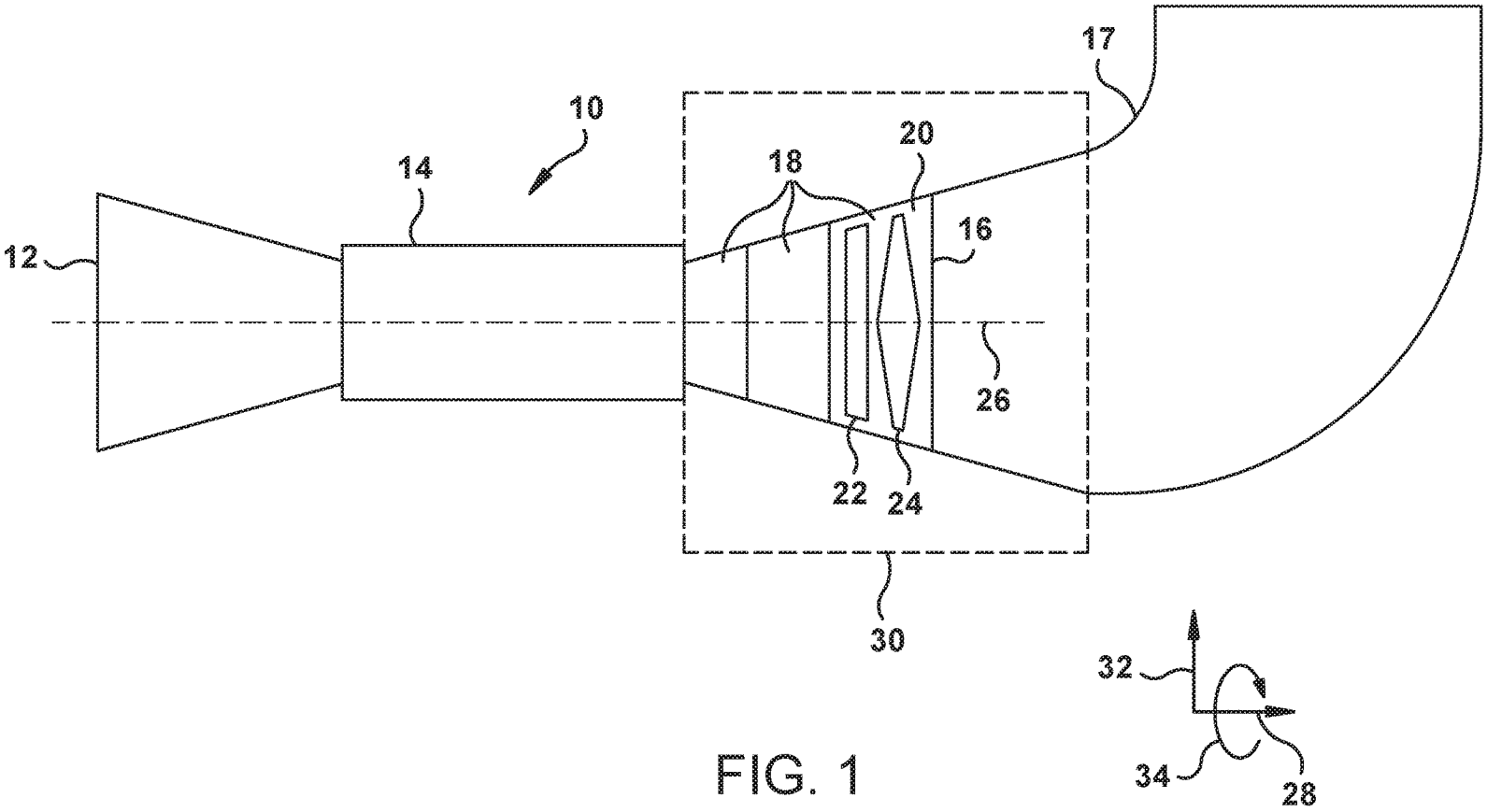
FIG. 1 is a diagram of a turbomachine in accordance with aspects of the present disclosure.

FIG. 1 is a diagram of one embodiment of a turbomachine 10 (e.g., a gas turbine and/or a compressor). The turbomachine 10 shown in FIG. 1 includes a compressor 12, a combustor 14, a turbine 16, and a diffuser 17. Air, or some other gas, is compressed in the compressor 12, fed into the combustor 14 and mixed with fuel, and then combusted. The exhaust fluids are fed to the turbine 16 where the energy from the exhaust fluids is converted to mechanical energy. The turbine 16 includes a plurality of stages 18, including an individual stage 20. Each stage 18, includes a rotor (i.e., a rotating shaft) with an annular array of axially aligned blades, which rotates about a rotational axis 26, and a stator with an annular array of nozzles. Accordingly, the stage 20 may include a nozzle stage 22 and a blade stage 24. For clarity, FIG. 1 includes a coordinate system including an axial direction 28, a radial direction 32, and a circumferential direction 34. Additionally, a radial plane 30 is shown. The radial plane 30 extends in the axial direction 28 (along the rotational axis 26) in one direction, and then extends outward in the radial direction 32.

Figure 2:
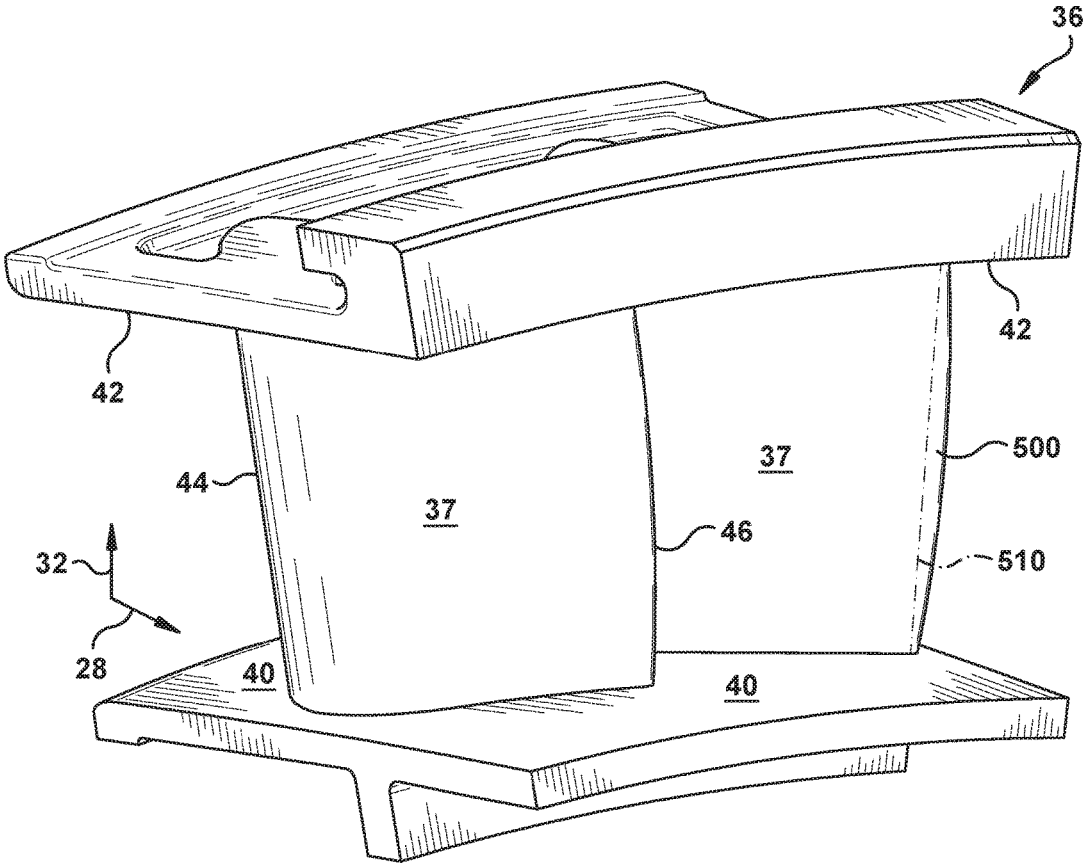
FIG. 2 is a perspective view of a nozzle in accordance with aspects of the present disclosure.

FIG. 2 is a perspective view of two nozzles 36. The nozzles 36 in the stage 20 extend in a radial direction 32 between a first wall (or platform) 40 and a second wall 42. First wall 40 is opposed to second wall 42, and both walls define a pathway into which a fluid flow is receivable. The nozzles 36 are disposed circumferentially 34 about a hub. Each nozzle 36 has an airfoil 37, and the airfoil 37 is configured to aerodynamically interact with the exhaust fluids from the combustor 14 as the exhaust fluids flow generally downstream through the turbine 16 in the axial direction 28. Each nozzle 36 has a leading edge 44, a trailing edge 46 disposed downstream, in the axial direction 28, of the leading edge 44, a pressure side 48, and a suction side 50. The pressure side 48 extends in the axial direction 28 between the leading edge 44 and the trailing edge 46, and in the radial direction 32 between the first wall 40 and the second wall 42. The suction side 50 extends in the axial direction 28 between the leading edge 44 and the trailing edge 46, and in the radial direction 32 between the first wall 40 and the second wall 42, opposite the pressure side 48. The nozzles 36 in the stage 20 are configured such that the pressure side 48 of one nozzle 36 faces the suction side 50 of an adjacent nozzle 36. As the exhaust fluids flow toward and through the passage between nozzles 36, the exhaust fluids aerodynamically interact with the nozzles 36 such that the exhaust fluids flow with an angular momentum or velocity relative to the axial direction 28. A nozzle stage 22 populated with nozzles 36 having a specific throat distribution configured to exhibit reduced aerodynamic loss and improved aerodynamic loading may result in improved machine efficiency and part longevity.

Figure 3:
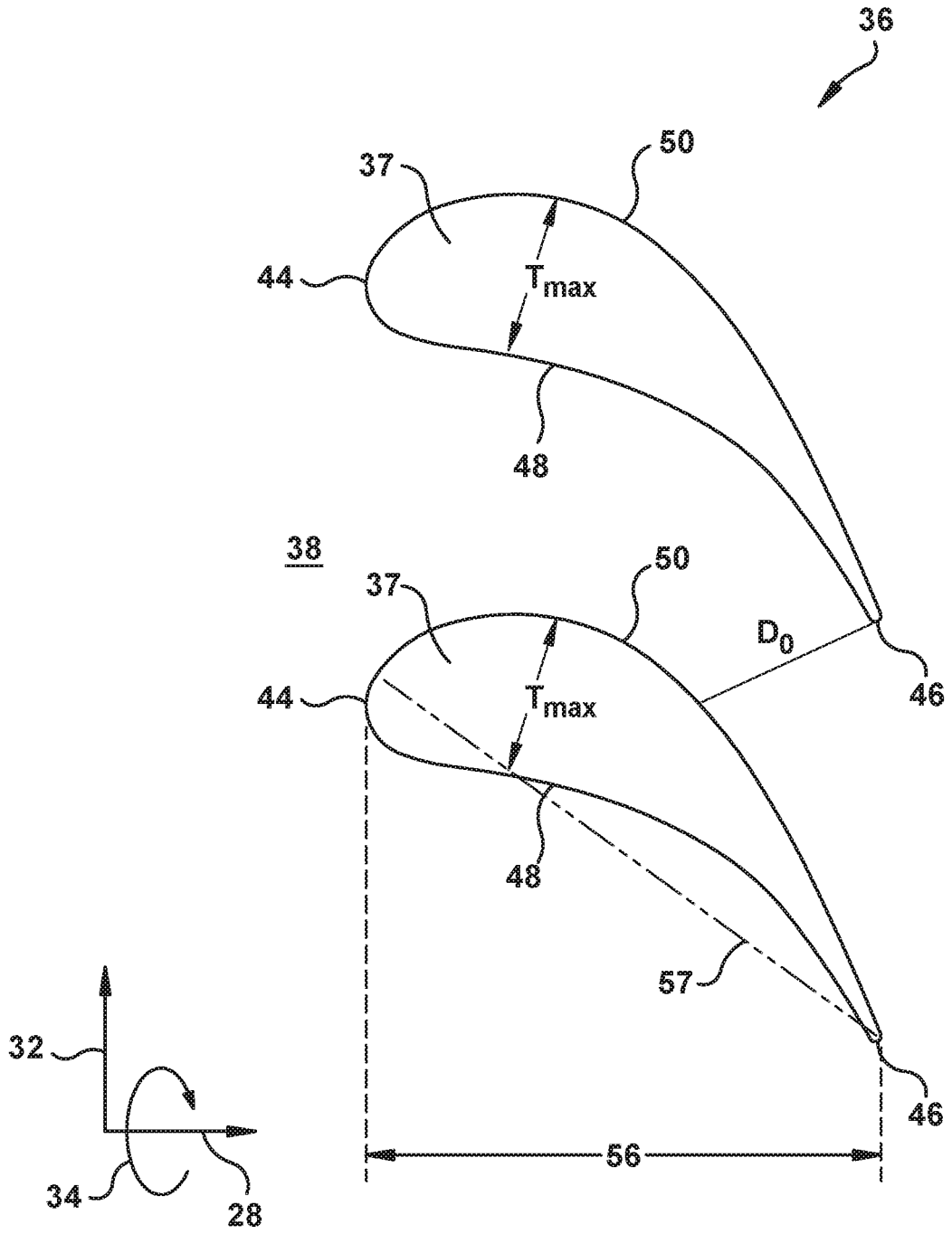
FIG. 3 is a top view of two adjacent nozzles in accordance with aspects of the present disclosure.

FIG. 3 is a top view of two adjacent nozzles 36. Note that the suction side 50 of the bottom nozzle 36 faces the pressure side 48 of the top nozzle 36. The axial chord 56 is the dimension of the nozzle 36 in the axial direction 28. The chord 57 is the distance between the leading edge and trailing edge of the airfoil. The passage 38 between two adjacent nozzles 36 of a stage 18 defines a throat distribution $D_o$, measured at the narrowest region of the passage 38 between adjacent nozzles 36. Fluid flows through the passage 38 in the axial direction 28. This throat distribution $D_o$ across the span from the first wall 40 to the second wall 42 will be discussed in more detail in regard to FIG. 4. The maximum thickness of each nozzle 36 at a given percent span is shown as Tmax. The Tmax distribution across the height of the nozzle 36 will be discussed in more detail in regard to FIG. 4.

Figure 4:
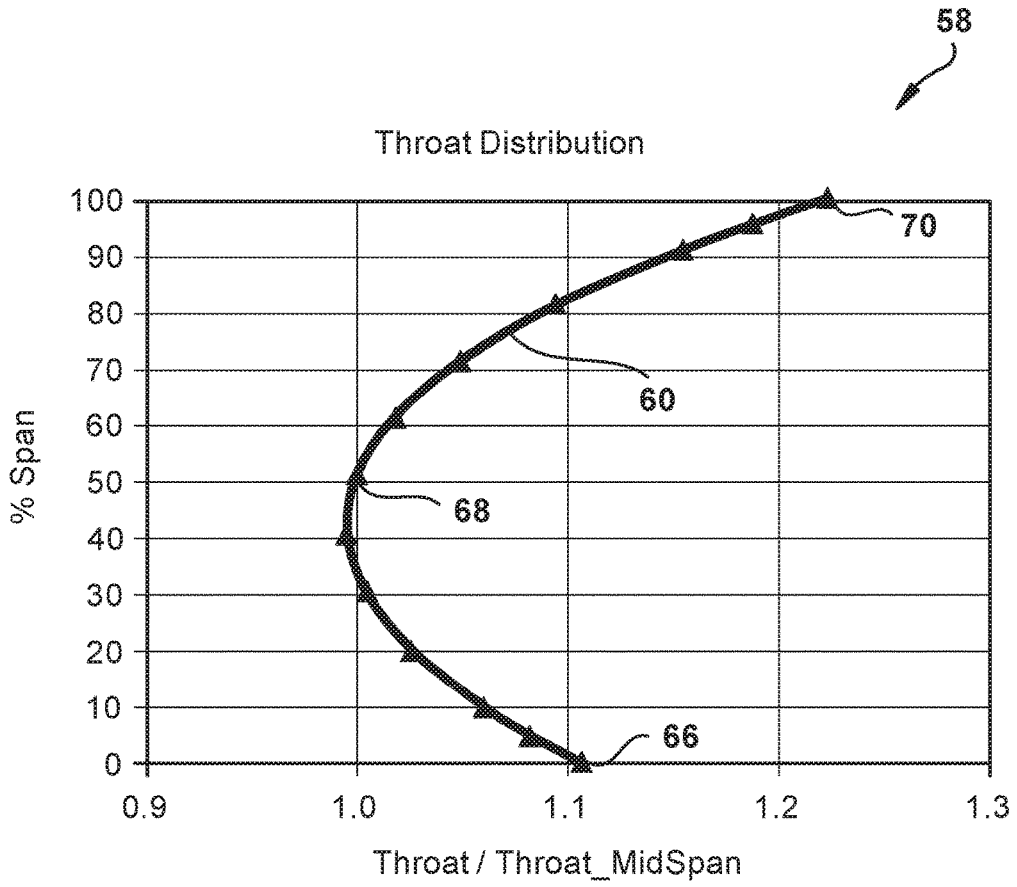
FIG. 4 is a plot of throat distribution in accordance with aspects of the present disclosure.

FIG. 4 is a plot of throat distribution $D_o$ defined by adjacent nozzles 36 and shown as curve 60. The vertical axis represents the percent span between the first annular wall 40 and the second annular wall 42 or opposing end of airfoil 37 in the radial direction 32. That is, 0% span generally represents the first annular wall 40 and 100% span represents the opposing end of airfoil 37, and any point between 0% and 100% corresponds to a percent distance between the radially inner and radially outer portions of airfoil 37, in the radial direction 32 along the height of the airfoil. The horizontal axis represents $D_o$ (Throat), the shortest distance between two adjacent nozzles 36 at a given percent span, divided by the $D_{o_MidSpan}$ (Throat_MidSpan), which is the $D_o$ at about 50% to about 55% span. Dividing $D_o$ by the $D_{o_MidSpan}$ makes the plot 58 non-dimensional, so the curve 60 remains the same as the nozzle stage 22 is scaled up or down for different applications. One could make a similar plot for a single size of turbine in which the horizontal axis is just $D_o$.

As can be seen in FIG. 4, the throat distribution, as defined by a trailing edge of the nozzle, extends curvilinearly from a throat/throat_mid-span value of about 111% at about 0% span (point 66) to a throat/throat_mid-span value of about 100% at about 51% span (point 68), and to a throat/throat mid-span value of about 122% at about 100% span (point 70). The span at 0% is at a radially inner portion of the airfoil and the span at 100% is at a radially outer portion of the airfoil. The throat/throat mid-span value is 100% at about 51% span (point 68). The throat distribution shown in FIG. 4 may help to improve performance in two ways. First, the throat distribution helps to produce desirable exit flow profiles. Second, the throat distribution shown in FIG. 4 may help to manipulate secondary flows (e.g., flows transverse to the main flow direction) and/or purge flows near the first annular wall 40 (e.g., the hub). Table 1 lists the throat distribution and various values for the trailing edge shape of the airfoil 37 along multiple span locations. FIG. 4 is a graphical illustration of the throat distribution. It is to be understood that the throat distribution values may vary by about +/−10%.

TABLE 1

| % Span | Throat/Throat_MidSpan |
|---|---|
| 100 | 1.2228 |
| 95.45 | 1.1872 |
| 90.78 | 1.1538 |
| 81.18 | 1..0945 |
| 71.32 | 1.0494 |
| 61.25 | 1.0179 |
| 50.99 | 1 |
| 40.61 | 0.9958 |
| 30.26 | 1.0048 |
| 19.99 | 1.0263 |
| 9.86 | 1.0605 |
| 4.88 | 1.0822 |
| 0 | 1.1065 |

Figure 5:
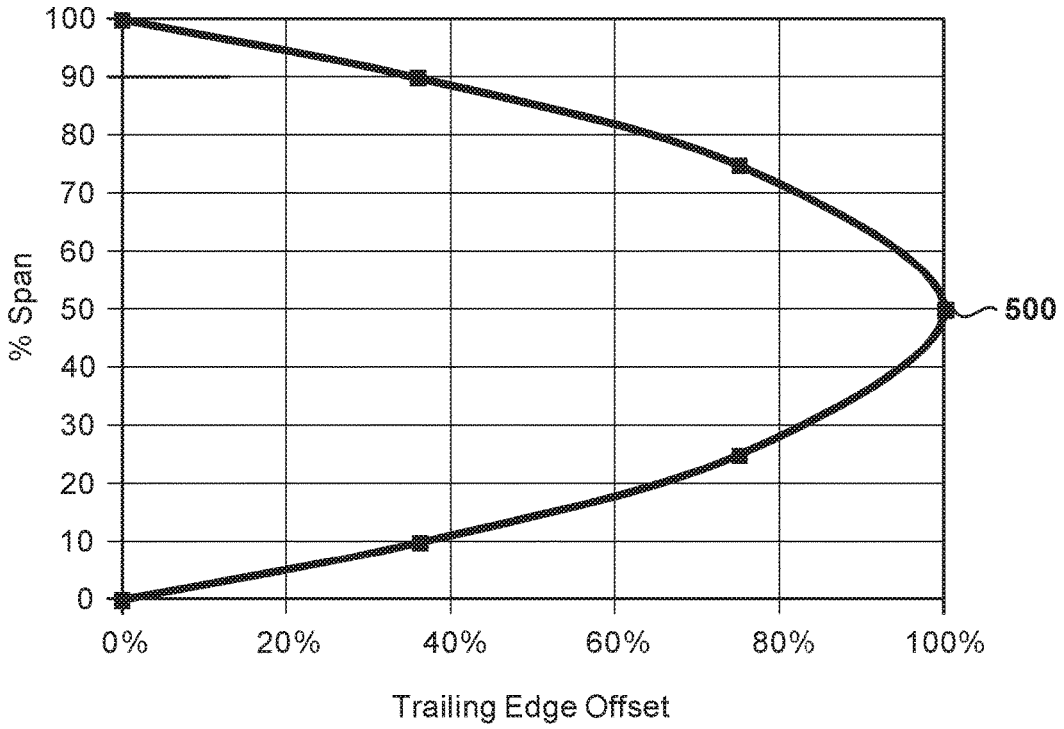
FIG. 5 is a plot of trailing edge offset in accordance with aspects of the present disclosure.

FIG. 5 is a plot of a trailing edge offset of the airfoil 37 of nozzle 36. The trailing edge 46 has a protrusion 500 at about 50% span. The vertical axis represents the percent span between the first annular wall 40 and opposing end of airfoil 37 in the radial direction 32. The horizontal axis represents the trailing edge offset from a straight line extending from a line 510 (see FIG. 2) that extends from a radially inner portion of the trailing edge to a radially outer portion of the trailing edge. The protrusion 500 is greatest (i.e., 1 or 100%) at about 50% span, and then gradually transitions back to a 0 offset at about 0% span and about 100% span. As one example only, the maximum trailing edge offset (i.e., at about 50% span) may be about 0.25 inches, however this will change as the nozzle is scaled up or down. Additionally, a nozzle 36 with a trailing edge offset increased around 50% span may help to tune the resonant frequency of the nozzle in order to avoid crossings with drivers. If the resonant frequency of the nozzle is not carefully tuned to avoid crosses with the drivers, operation may result in undue stress on the nozzle 36 and possible structural failure. Accordingly, a nozzle 36 design with the protrusion 500 or increased trailing edge offset shown in FIG. 5 may increase the operational lifespan of the nozzle 36. Table 2 lists the trailing edge offset and protrusion shape for various values of the trailing edge of the airfoil 37 along multiple span locations.

TABLE 2

| % Span | Trailing Edge Offset |
|---|---|
| 100 | 0 |
| 90 | 0.359 |
| 75 | 0.749 |
| 50 | 1 |
| 25 | 0.749 |
| 10 | 0.363 |
| 0 | 0 |

Figure 6:
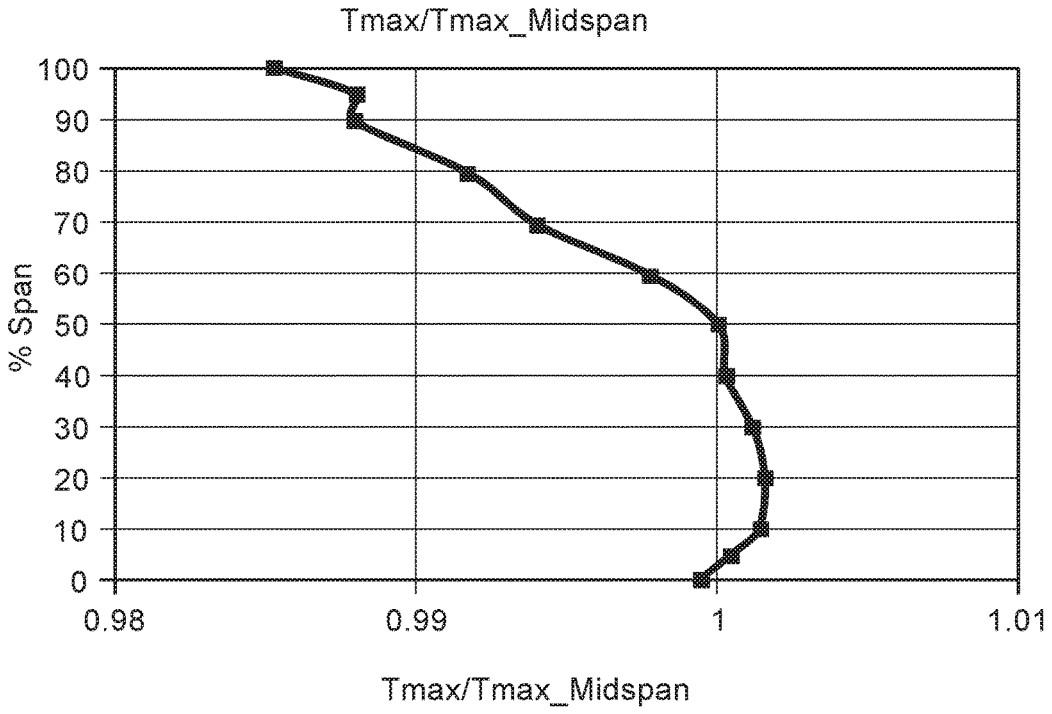
FIG. 6 is a plot of maximum thickness distribution in accordance with aspects of the present disclosure.

FIG. 6 is a plot of the thickness distribution Tmax/Tmax_Midspan, as defined by a thickness of the nozzle's airfoil 37. The vertical axis represents the percent span between the first annular wall 40 and opposing end of airfoil 37 in the radial direction 32. The horizontal axis represents the Tmax divided by Tmax_Midspan value. Tmax is the maximum thickness of the airfoil at a given span, and Tmax_Midspan is the maximum thickness of the airfoil at mid-span (e.g., about 50% to 55% span). Dividing Tmax by Tmax_Midspan makes the plot non-dimensional, so the curve remains the same as the nozzle stage 22 is scaled up or down for different applications. Referring to Table 3, a mid-span value of about 50% has a Tmax/Tmax_Midspan value of 1, because at this span Tmax is equal to Tmax_Midspan.

TABLE 3

| % Span | Tmax/Tmax_MidSpan |
|---|---|
| 100 | 0.985 |
| 94.81 | 0.988 |
| 89.66 | 0.988 |
| 79.49 | 0.992 |
| 69.48 | 0.994 |
| 59.63 | 0.998 |
| 49.79 | 1.000 |
| 39.95 | 1.000 |
| 30.10 | 1.001 |
| 20.16 | 1.002 |
| 10.13 | 1.001 |
| 5.08 | 1.000 |
| 0 | 0.999 |

Figure 7:
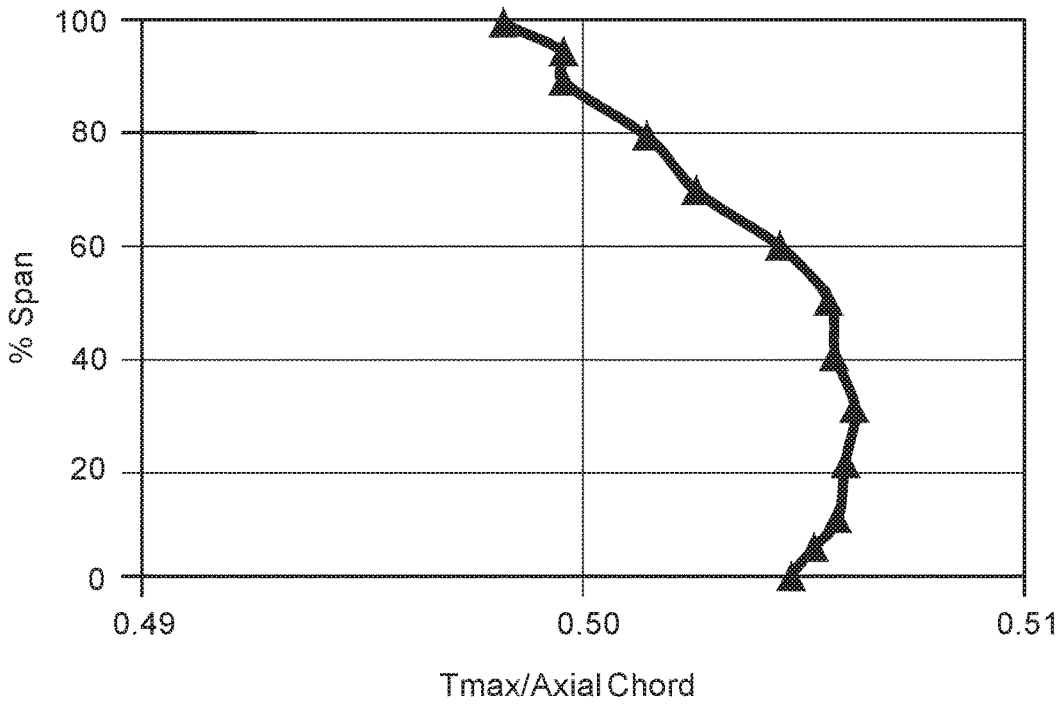
FIG. 7 is a plot of maximum thickness divided by axial chord distribution in accordance with aspects of the present disclosure.

FIG. 7 is a plot of the airfoil thickness (Tmax) divided by the airfoil's axial chord along various values of span. The vertical axis represents the percent span between the first annular wall 40 and opposing end of airfoil 37 in the radial direction 32. The horizontal axis represents the Tmax divided by axial chord value. Dividing the airfoil thickness by the axial chord makes the plot non-dimensional, so the curve remains the same as the nozzle stage 22 is scaled up or down for different applications. A nozzle design with the Tmax distribution shown in FIGS. 6 and 7 may help to tune the resonant frequency of the nozzle in order to avoid crossings with drivers. Accordingly, a nozzle 36 design with the Tmax distribution shown in FIGS. 6 and 7 may increase the operational lifespan of the nozzle 36. Table 4 lists the Tmax/Axial Chord value for various span values, where the non-dimensional thickness is defined as a ratio of Tmax to axial chord at a given span.

TABLE 4

| % Span | Tmax/Chord |
|---|---|
| 100 | 0.498 |
| 94.81 | 0.499 |
| 89.66 | 0.499 |
| 79.49 | 0.501 |
| 69.48 | 0.503 |
| 59.63 | 0.504 |
| 49.79 | 0.506 |
| 39.95 | 0.506 |
| 30.10 | 0.506 |
| 20.16 | 0.506 |
| 10.13 | 0.506 |
| 5.08 | 0.505 |
| 0 | 0.505 |

Figure 8:
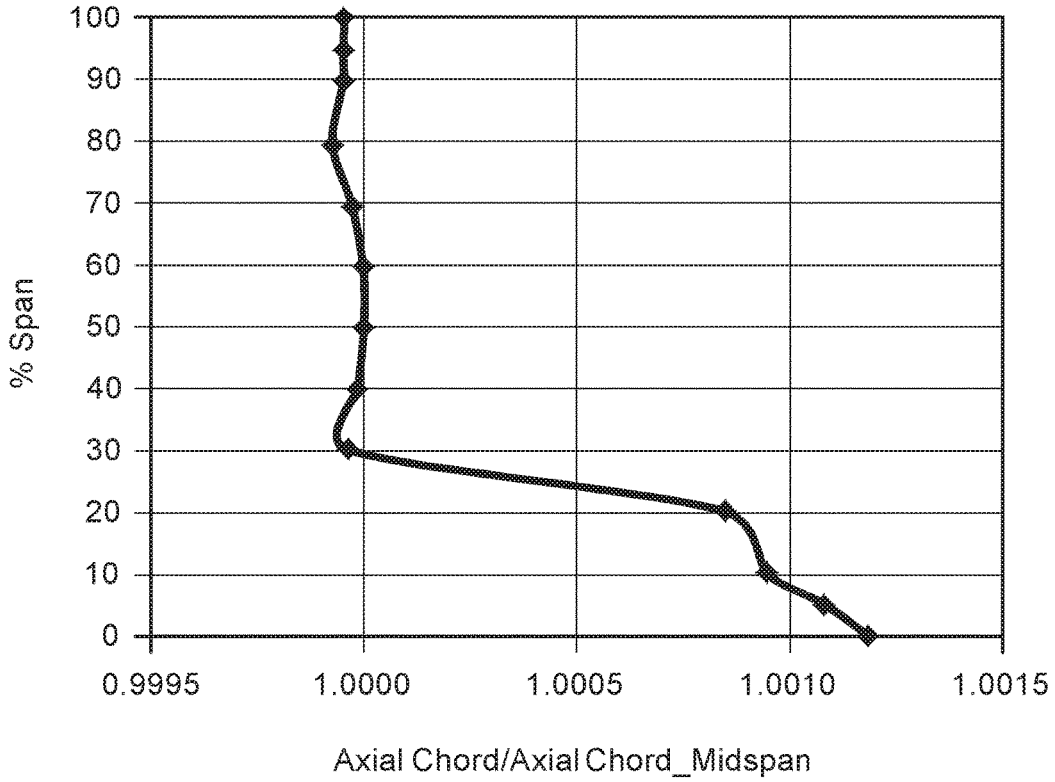
FIG. 8 is a plot of axial chord divided by axial chord at mid-span in accordance with aspects of the present disclosure.

FIG. 8 is a plot of the airfoil's axial chord divided by the axial chord value at mid-span along various values of span. The vertical axis represents the percent span between the first annular wall 40 and opposing end of airfoil 37 in the radial direction 32. The horizontal axis represents the axial chord divided by axial chord at mid-span value. Referring to Table 5, a mid-span value of about 50% has a Axial Chord/Axial Chord_MidSpan value of 1, because at this span axial chord is equal to axial chord at the mid-span location. Dividing the axial chord by the axial chord at mid-span makes the plot non-dimensional, so the curve remains the same as the nozzle stage 22 is scaled up or down for different applications. Table 5 lists the values for the airfoil's axial chord divided by the axial chord value at mid-span along various values of span, where the non-dimensional axial chord is defined as a ratio of axial chord at a given span to axial chord at mid-span.

TABLE 5

| % Span | Axial Chord/Axial Chord_MidSpan |
|---|---|
| 100 | 0.99995 |
| 94.81 | 0.99995 |
| 89.66 | 0.99995 |
| 79.49 | 0..99993 |
| 69.48 | 0.99997 |
| 59.63 | 1.00000 |
| 49.79 | 1.00000 |
| 39.95 | 0.99999 |
| 30.10 | 0.99996 |
| 20.16 | 1.00085 |
| 10.13 | 1.00094 |
| 5.08 | 1.00108 |
| 0 | 1.00118 |

A nozzle design with the axial chord distribution shown in FIG. 8 may help to tune the resonant frequency of the nozzle in order to avoid crossings with drivers. For example, a nozzle with a linear design may have a resonant frequency of 400 Hz, whereas the nozzle 36 with an increased thickness around certain spans may have a resonant frequency of 450 Hz. If the resonant frequency of the nozzle is not carefully tuned to avoid crosses with the drivers, operation may result in undue stress on the nozzle 36 and possible structural failure. Accordingly, a nozzle 36 design with the axial chord distribution shown in FIG. 8 may increase the operational lifespan of the nozzle 36.

Technical effects of the disclosed embodiments include improvement to the performance of the turbine in a number of different ways. First, the nozzle 36 design and the throat distribution shown in FIG. 4 may help to manipulate secondary flows (i.e., flows transverse to the main flow direction) and/or purge flows near the hub (e.g., the first annular wall 40). Second, a nozzle 36 with a protrusion 500 around 50% span may help to tune the resonant frequency of the nozzle in order to avoid crossings with drivers. If the resonant frequency of the nozzle is not carefully tuned to avoid crosses with the drivers, operation may result in undue stress on the nozzle 36 and possible structural failure. Accordingly, a nozzle 36 design with the increased thickness at specific span locations may increase the operational lifespan of the nozzle 36.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A turbomachine comprising a plurality of nozzles, each nozzle comprising an airfoil, the turbomachine comprising:

opposing walls defining a pathway into which a fluid flow is receivable to flow through the pathway, a throat distribution is measured at a narrowest region in the pathway between adjacent nozzles, at which adjacent nozzles extend across the pathway between the opposing walls to aerodynamically interact with the fluid flow; and the airfoil defining the throat distribution, the throat distribution reducing aerodynamic loss and improving aerodynamic loading on each airfoil, the throat distribution defined by values set forth in Table 1, and wherein the throat distribution values are within a +/−10% tolerance of the values set forth in Table 1.

2. The turbomachine of claim 1, a trailing edge of the airfoil having a protrusion at about 50% span, and the trailing edge of the airfoil having an offset as defined by values set forth in Table 2.

3. The turbomachine of claim 1, the airfoil having a thickness distribution (Tmax/Tmax_Midspan) as defined by values set forth in Table 3.

4. The turbomachine of claim 1, the airfoil having a non-dimensional thickness distribution according to values set forth in Table 4.

5. The turbomachine of claim 1, the airfoil having a non-dimensional axial chord distribution according to values set forth in Table 5.

6. A nozzle having an airfoil, the nozzle configured for use with a turbomachine, the airfoil comprising:

a throat distribution measured at a narrowest region in a pathway between adjacent nozzles, at which adjacent nozzles extend across the pathway between opposing walls to aerodynamically interact with a fluid flow; and the airfoil defining the throat distribution, the throat distribution reducing aerodynamic loss and improving aerodynamic loading on the airfoil, and the throat distribution, as defined by a trailing edge of the nozzle, extending curvilinearly from a throat/throat mid-span value of about 111% at about 0% span to a throat/throat mid-span value of about 100% at about 51% span, to a throat/throat mid-span value of about 123% at about 100% span, wherein the span at 0% is at a radially inner portion of the airfoil and a span at 100% is at a radially outer portion of the airfoil.

7. The nozzle of claim 6, the throat distribution defined by values set forth in Table 1, and wherein the throat distribution values are within a +/−10% tolerance of the values set forth in Table 1.

8. The nozzle of claim 7, a trailing edge of the airfoil having a protrusion at about 50% span.

9. The nozzle of claim 8, a trailing edge of the airfoil having an offset of about 0 at 0% span, about 100% at about 50% span and 0 at 100% span.

10. The nozzle of claim 9, a trailing edge of the airfoil having an offset as defined by values set forth in Table 2.

11. The nozzle of claim 10, the airfoil having a thickness distribution (Tmax/Tmax_Midspan) as defined by values set forth in Table 3.

12. The nozzle of claim 11, the airfoil having a non-dimensional thickness distribution according to values set forth in Table 4.

13. The nozzle of claim 12, the airfoil having a non-dimensional axial chord distribution according to values set forth in Table 5.

14. A nozzle having an airfoil, the nozzle configured for use with a turbomachine, the airfoil comprising:

a throat distribution measured at a narrowest region in a pathway between adjacent nozzles, at which adjacent nozzles extend across the pathway between opposing walls to aerodynamically interact with a fluid flow; and the airfoil defining the throat distribution, the throat distribution defined by values set forth in Table 1, and wherein the throat distribution values are within a +/−10% tolerance of the values set forth in Table 1, the throat distribution reducing aerodynamic loss and improving aerodynamic loading on the airfoil.

15. The nozzle of claim 14, a trailing edge of the airfoil having a protrusion at about 50% span, and the trailing edge of the airfoil having an offset as defined by values set forth in Table 2.

16. The nozzle of claim 14, the airfoil having a thickness distribution (Tmax/Tmax_Midspan) as defined by values set forth in Table 3.

17. The nozzle of claim 14, the airfoil having a non-dimensional thickness distribution according to values set forth in Table 4.

18. The nozzle of claim 14, the airfoil having a non-dimensional axial chord distribution according to values set forth in Table 5.

* * * * *